United States Patent [19]

Kanzaka

[11] Patent Number: 4,998,660

[45] Date of Patent: Mar. 12, 1991

[54] APPARATUS FOR DELIVERING BUTTON BODY

[75] Inventor: Yoshiro Kanzaka, Toyama, Japan

[73] Assignee: Yoshida Kogyo K.K., Tokyo, Japan

[21] Appl. No.: 503,672

[22] Filed: Apr. 3, 1990

[30] Foreign Application Priority Data

Apr. 4, 1989 [JP] Japan ..... 1-39672

[51] Int. Cl.[5] ..... A41H 37/04; A41H 37/10

[52] U.S. Cl. ..... 227/18; 227/119

[58] Field of Search ..... 227/18, 120, 119, 114, 227/115, 116, 156

[56] References Cited

U.S. PATENT DOCUMENTS

| | | | |
|---|---|---|---|
| 3,750,925 | 8/1973 | Schmidt et al. | 227/18 |
| 3,964,661 | 6/1976 | Schmidt et al. | 227/18 |
| 4,606,487 | 8/1986 | Douri | 227/116 X |
| 4,615,473 | 10/1986 | Taga | 227/18 X |
| 4,765,524 | 8/1988 | Yoshieda | 227/18 |
| 4,795,072 | 1/1989 | Sodeno | 227/18 |
| 4,799,611 | 1/1989 | Taga | 227/18 |
| 4,840,301 | 6/1989 | Seki | 227/18 X |
| 4,923,099 | 5/1990 | Hasegawa et al. | 227/114 |

FOREIGN PATENT DOCUMENTS

| | | | |
|---|---|---|---|
| 3313066 | 10/1984 | Fed. Rep. of Germany | 227/18 |

*Primary Examiner*—Paul A. Bell

*Attorney, Agent, or Firm*—Hill, Van Santen, Steadman & Simpson

[57] ABSTRACT

An apparatus for delivering a button body with a hub and a flange applied to a part between a chute through which the button body is fed gravitationally from a hopper and a button feeder of a button applicator to which the button body is delivered. According to a preferred embodiment, a receiving member, which is pivotably fixed to a stopper placed facing an outlet of the chute and which is urged to the chute by a spring, has a receiving projection as well as a cam projection. A pusher moving backward and forward along a space between the receiving member and the outlet of the chute is provided with a cam receiving surface including a notch on its side face facing the receiving member. A pocket is formed by the fore end of the pusher and the inner face of the receiving projection in order to receive the hub of the button body. The receiving projection is pivotable moved off or moved in close to the chute in conjunction with the movement of the pusher by the cam receiving surface including the notch, the cam projection and the spring so that the button body can be passed to the button feeder smoothly without being forced by any other members.

3 Claims, 5 Drawing Sheets

APPARATUS FOR DELIVERING BUTTON BODY

BACKGROUND OF THE INVENTION

1. Field of the Invention

This invention relates to an apparatus for delivering a button body with a hub and a flange fed from a chute to a button feeder of a button applicator for caulking a tack member to a button body through a fabric piece.

2. Description of the Prior Art

According to an apparatus for delivering button body of this kind disclosed in U.S. Pat. No. 3,964,661, a receiving member receives a button body fed from a chute, and a pusher pushes the button body to a pocket below a ram through a button feeder. The receiving member is urged to the chute by a spring. Accordingly, when the button body is delivered to the button feeder, the receiving member is forced to open against the spring by the button body itself.

In order to deliver the button body from the receiving member to the button feeder, the receiving member is forced to open against the spring. In this case, the button body is rubbed by the receiving member to be damaged and can not be delivered smoothly.

SUMMARY OF THE INVENTION

According to the present invention, a stopper is placed facing an outlet of a chute while it is spaced apart the outlet and contacts the periphery of a flange of a button body during delivering operation. A receiving member, which is provided with a receiving projection projecting toward the chute at the button feeder-side fore end of the receiving member, is pivoted to the underside of the stopper at its behind side. The side face of the receiving member and the inner side face of the receiving projection receive a hub of the button body. A pusher moves backward and forward to a button feed path of a button feeder along a longitudinal space between the receiving member and the outlet of the chute and pushes the button body with its fore end for feeding the button body to the button applicator. A pocket is formed by the fore end of the pusher together with the inner face of the receiving projection in order to receive the hub of the button body. A means for swinging the receiving projection provided between the receiving member and the pusher, bywhich the receiving projection is moved off the chute with an enough space permitting the button body to pass freely when the pusher begins to move forward and bywhich the receiving projection is moved in close to the chute when the pusher moves backward.

The button body fed from the outlet of the chute is prevented from moving forward by the stoper and the receiving member. In this case, the pocket, where the button body stays, is formed by the pusher locating at the extreme backward position together with the receiving projection moved in close to the chute. Then, the pusher begins to move forward while it holds the button body on its fore end portion in order to push the hub of the button body. At the same time, by the means for swinging the receiving projection, the receiving projection is moved off the chute to permit the button body to pass freely to a button feeder. As a result, as the button body is pushed by only the pusher and it does not contact with any other members, it can be delivered smoothly to the button feeder.

It is an object of the present invention to provide an apparatus for delivering a button body to a button feeder smoothly without damage on the button body.

Further objects and advantages of the present invention will be apparent from the following description, reference being had to the accompanying drawing wherein preferred embodiments of the present invention are clearly shown.

DESCRIPTION OF THE PREFERRED EMBODIMENT

An apparatus for delivering a button body with a hub and a flange of this invention is applied to a part between a chute through which the button body is fed gravitationally from a hopper and a button feeder of a button applicator to which the button body is delivered. As shown in above mentioned U.S. Pat. No. 3,964,661 and the like, these apparatuses around the apparatus for delivering the button body are well known. Hence a detailed explanation about other apparatuses than the apparatus of the present invention is omitted.

Figure 1:
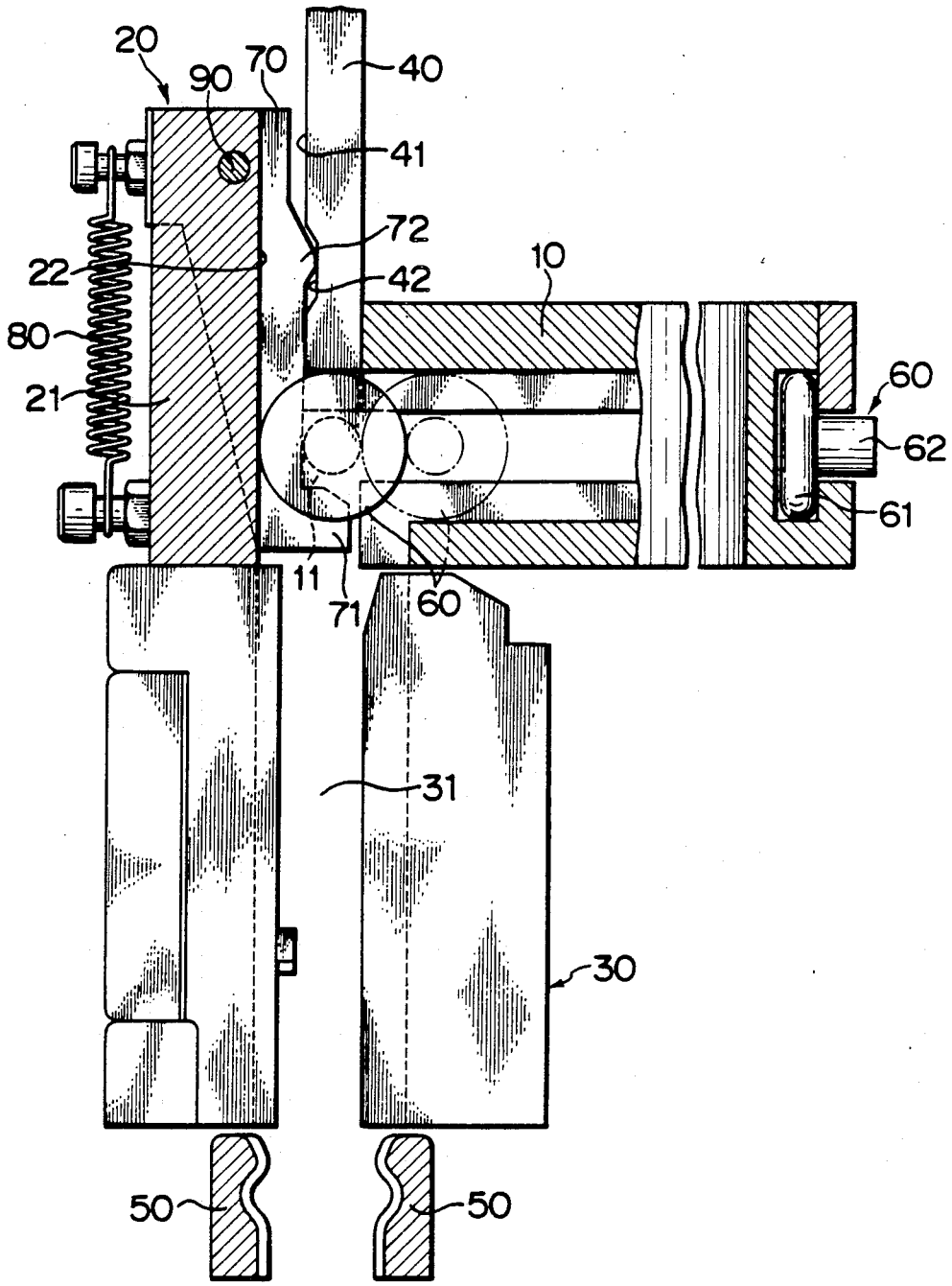
FIG. 1 is a segmentary sectional plan view of the present invention.
Figure 2:
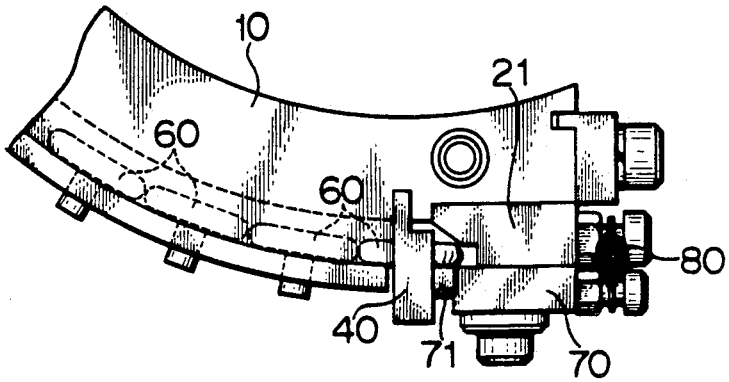
FIG. 2 is a side view showing the relation of a delivering apparatus and a chute.

FIG. 1 is a top view, partly in cross section, of the apparatus for delivering a button body 60 of this invention. Referring to this figure, the button body 60 is fed from a hopper (not shown) to through a chute 10. Then, a delivering member 20 grips temporarily the button body 60 fallen through the chute 10 and delivers the button body 60 to a button feeder 30. The button feeder 30 is a known apparatus which guides the button body 60 from the delivering member 20 to a pocket 50 below a punch of a button applicator by means of a pusher 40.

The chute 10 extends to be a C-shaped channel on its cross section having a T-slot at its underside longitudinally. Accordingly, the button body 60 is fed through the chute 10 gravitationally while a hub 62 projects from the T-slot and the button body 60 slides through the T-slot.

The delivering member 20 is composed of a block type stopper 21 which is placed facing the outlet of the chute 10 while it is spaced apart the outlet and which contacts the periphery of a flange 61 of the button body 60 during delivering operation, a receiving member 70 which is pivoted about a pivot pin 90 to the underside of the stopper 21 at its behind side and a suspension coil spring 80 connected between the stopper 21 and the receiving member 70 normally urging the side face of the fore end of the receiving member 70 toward the chute 10.

The fore end portion of the pusher 40 is beveled with a right angle for supporting and urging upward the button body 60 at the rear face of the flange 61.

Figure 3:
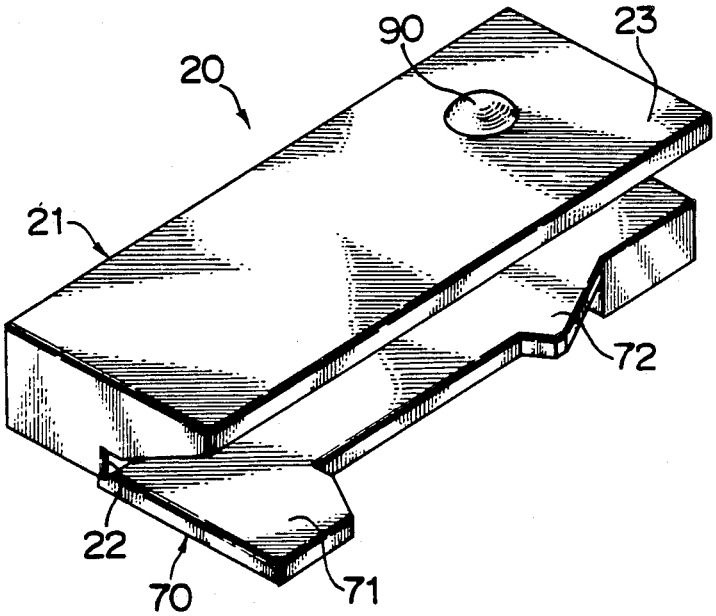
FIG. 3 is a perspective view of a delivering apparatus.

As ahown in FIG. 3, the stopper 21 has a stopper surface 22 on its internal side face facing the shute 10, which receives a periphery of the flange 61 of the button body 60 fallen through the chute 10, together with an over hang 23, which protudes vertically in relation to the stopper surface 22 toward the chute 10, prevents the button body 60 from falling caused as a reaction when it hits the stopper surface 22.

As shown in FIGS. 1 and 3, the receiving member 70 has a cam projection 72 projecting toward the chute 10 at its pivot pin-side portion and a receiving projection 71 projecting toward the chute 10 at its fore end portion. A pocket 11 for receiving the hub 62 of the button body 60 is formed by the receiving projection 71, the outlet of the chute 10, a front face of the pusher 40 and a receiving surface of the receiving member 70. Therefore, when the button body 60 is fallen through the chute 10, the flange 61 of the button body 60 normally hits the stopper surface 22 of the stopper 21 while the hub 62 is received in the pocket 11. In this case, the receiving projection 71 of the receiving member 70 stops the button body 60 to be delivered the button feeder 30. Accordingly, the button body 60 stays in the pocket 11 before the pusher 40 beings to push the button body 60. The receiving member 70 and the pusher 40 support upward the button body 60 at the rear face of the flange 61.

The pusher 40 has a notch 42 in which the cam projection 72 of the receiving member 70 is engaged with clearance when the pusher 40 locates an extreme backward position.

The button feeder 30 has a button feed path 31 which is disposed between the two members of the button feeder and along which the button body 60 is guided to the pocket 50 while the button body 60 rotates and is indexed the direction of a surface pattern provided on its front face.

The apparatus for delivering the button body 60 of the present invention has the above mentioned composition. Its operation is as follows.

Figure 4:
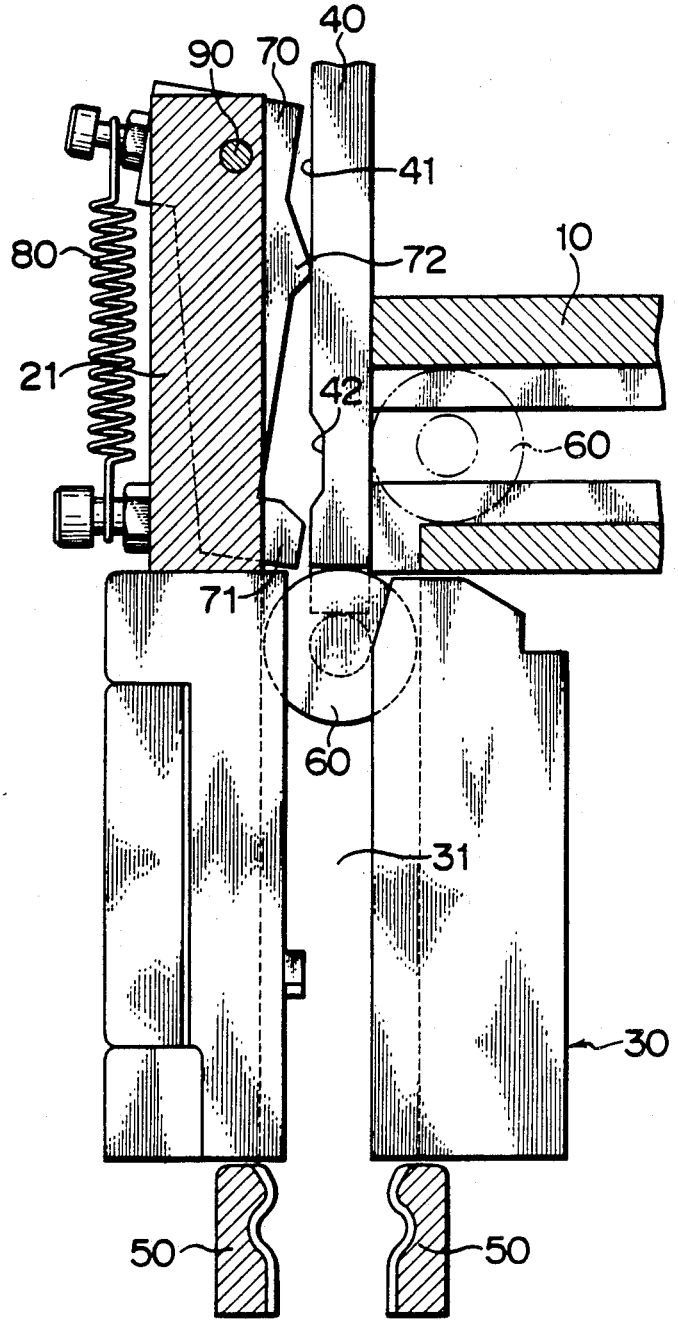
FIG. 4 is a view illustrating operation relating to FIG. 1.

The forward movement of the pusher 40 toward the button feeder 30 causes the cam projection 72 of the receiving member 70 to disengage from the notch 42 to mount on a cam receiving surface 41 of the pusher 40. Therefore, as shown in FIG. 4, the receiving memberr 70 pivots clockwise against the suspension coil spring 80, thus the receiving projection 71 is moved off the chute 10 with an enough space permitting the button body 60 to pass freely without any interference by the receiving projection 71 when the pusher 40 pushes the button body 60. The further forward movement of the pusher 40 guides the button body 60 along the button feed path 31 of the button feeder 30 to be gripped in the pocket 50 while the button body 60 is indexed the direction of the surface pattern provided on its front face by a known method. In this case, the side face of the pusher 40 which is opposite to the cam receiving surface 41 stops a falling of a next button body 60 from the chute 10 where the next button 60 is set to stay.

Then, when the pusher 40 moves backward to the extreme backward position, the next button body 60 is undertaken to engage in the pocket 11. At the same time, the cam projection 72 meets the notch 42 to cause the receiving member 70 to pivot counterclockwise by the suspension coil spring 80. In this instance, the receiving member 70 is arranged to receive and support upward the next button body 60 at the rear face of its flange 61. As result, the next button body 60 is delivered to the delivering member 20 smoothly.

Figure 5:
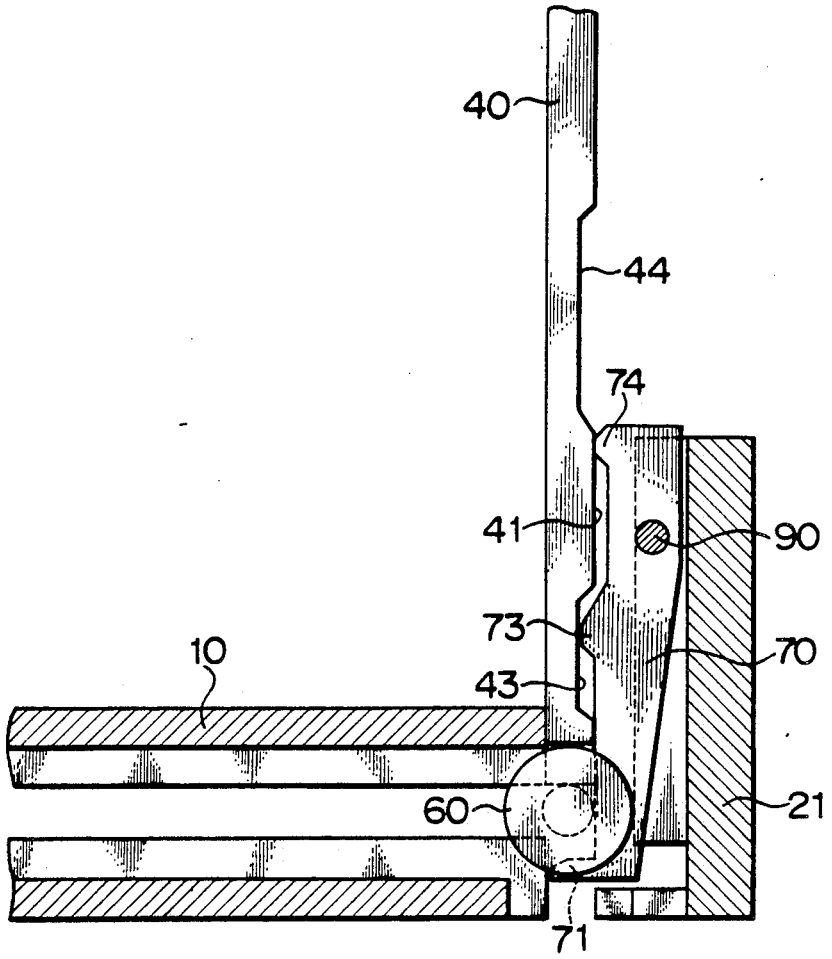
FIG. 5 is a segmentary sectional plan view showing another embodiment.
Figure 6:
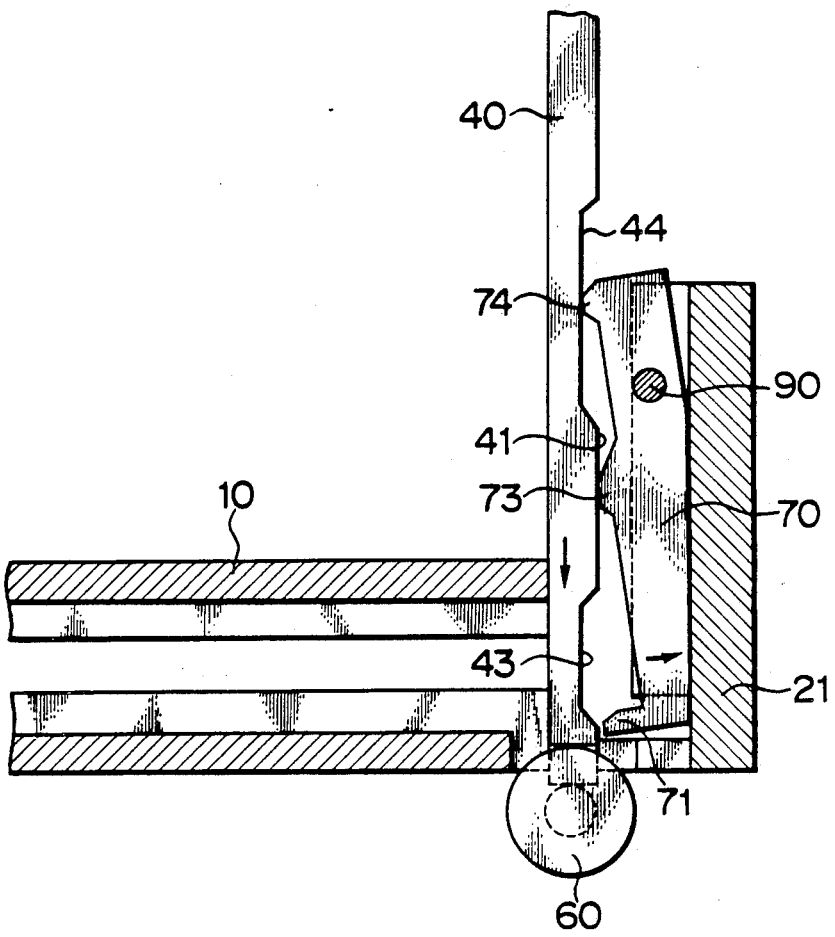
FIG. 6 is a view illustrating operation relating to FIG. 5.

Another embodiment of the delivering member 20 with a simple composition is shown in FIGS. 5 and 6. Instead of the suspension coil spring 80, a cam mechanism is applied for the means for swinging the receiving projection. The receiving member 70 has two cam projections; a front cam projection 73 and a back cam projection 74. The pivot pin 90 is provided on the receiving member 70 between the two cam projections 73 and 74. The pusher 40 has a front notch 43 and a back notch 44. As shown in FIG. 5, the two cam projections 73 and 74, and the two notches 43 and 44 are arranged to have a relative position so that when the pusher 40 moves backward, the front cam projection 73 engages in the front notch 43 and the back cam projection 74 mounts on the cam receiving surface 41 between the fron t notch 43 and the back notch 44. Then, as shown in FIG. 6, when the pusher 40 moves forward, the front cam projection 73 mounts on the cam receiving surface 41 and the back cam projection 74 engages in the back notch 44. Therefore, the receiving member 70 pivots counterclockwise about the pivot pin 90, thus the receiving projection 71 provided on the receiving member 70 at its fore end is moved off the chute 10 with the enough space permitting the button body 60 to pass freely. Accordingly, the button 60 can be fed smoothly by the pusher 40 without any interference by the receiving projection 71. When the pusher 40 moves backward, the back cam projection 74 of the receiving member 70 disengages from the back notch 44 of the pusher 40 to mount on the cam receiving surface 41. At the same time, the front cam projection 73 of the receiving member 70 engages in the front notch 43 of the pusher 40. Therefore, the receiving member 70 pivots clockwise about the pivot pin 90, thus the receiving projection 71 of the receiving member 70 is undertaken to receive and to support upward the next button body 60 at rear face of its flange 61. Finally, the button body 60 can be delivered smoothly from the chute 10 to the delivering member 20. In this instance, the two cam projections 73 and 74 and the cam receiving surface 41 including two notches 43 and 44 applied to the means for swinging the receiving projection permit the button body 60 to be received from the chute 10 and to be delivered to the button feeder 30 without any damage on its surface.

While preferred embodiments have been described, it is apparent that the present invention is not limited to the specific embodiments thereof.

What is claimed is:

1. An apparatus for delivering a button body with a hub and a flange placed vertically in relation to a chute at its an outlet guiding said button body fed from said chute to a button feeder of a button applicator by means of a pusher, comprising;

a stopper which is placed facing said outlet of said chute while it is spaced apart said outlet and which contacts said flange of said button body during delivering operation, a receiving member which is pivotably fixed to the pusher side of the underside of said stopper, which is provided with a receiving projection projecting toward said chute at its button feeder-side fore end and which receives said hub of said button body at its side face, said pusher which moves backward and forward to a button feed path of said button feeder along a longitudinal space between said receiving member and said outlet of said chute, which pushes said button body with its fore end for feeding said button body to said button applicator and whose fore end forms a pocket together with the inner face of said receiving projection in order to receive said hub of said button body and a means for swinging said receiving projection which is provided between said receiving member and said pusher, by which said receiving projection is pivotably moved off said chute with an enough space permitting said button body to pass freely when said pusher begins to move forward and by which said receiving projection is moved in close to said chute when said pusher moves backward.

2. An apparatus for delivering a button body of claim 1, wherein said means for swinging said receiving projection comprises a cam projection which is provided on said receiving member at its button feeder side before a pivot pin and which projects from its side face facing said pusher, a cam receiving surface which is formed on the side face of said pusher facing said receiving member and which includes a notch facing said cam projection of said receiving member and a spring which urges said cam projection toward said cam receiving surface.

3. An apparatus for delivering a button body of claim 1, wherein said means for swinging said receiving projection which comprises a front cam projection and a back cam projection which are provided on said receiving member before and behind respectively a pivot pin and which project from its side face facing said pusher and cam receiving surface which is formed on the side face of said pusher facing said receiving member and which includes a front notch and a back notch having a relative position with said two cam projections so that each of said two notches engages one of said two projections in an alternative way according to the backward or forward movement of said pusher.

* * * * *